US007077700B2

(12) United States Patent
Henningsen

(10) Patent No.: US 7,077,700 B2
(45) Date of Patent: Jul. 18, 2006

(54) COAXIAL CONNECTOR WITH BACK NUT CLAMPING RING

(75) Inventor: Jimmy C. Henningsen, Naestved (DK)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 11/018,748

(22) Filed: Dec. 20, 2004

(65) Prior Publication Data

US 2006/0134979 A1 Jun. 22, 2006

(51) Int. Cl.
*H01R 9/05* (2006.01)

(52) U.S. Cl. ..... 439/583

(58) Field of Classification Search ..... 439/578, 439/583, 584, 585
See application file for complete search history.

(56) References Cited

U.S. PATENT DOCUMENTS

| | | | | |
|---|---|---|---|---|
| 3,040,288 A | | 6/1962 | Edlen et al. | 339/103 |
| 3,199,061 A | | 8/1965 | Johnson et al. | 339/100 |
| 3,264,602 A | | 8/1966 | Schwartz | 339/177 |
| 3,291,895 A | | 12/1966 | Van Dyke | 174/88 |
| 3,320,575 A | | 5/1967 | Brown et al. | 339/268 |
| 3,675,181 A | | 7/1972 | Lankford et al. | 339/32 R |
| 3,678,446 A | | 7/1972 | Siebelist | 339/177 E |
| 3,757,279 A | | 9/1973 | Winston | 339/177 R |
| 3,829,800 A | | 8/1974 | Spinner | 333/97 R |
| 3,963,321 A | * | 6/1976 | Burger et al. | 439/584 |
| 4,046,451 A | | 9/1977 | Juds et al. | 339/177 R |
| 4,126,372 A | | 11/1978 | Hashimoto et al. | 339/177 E |
| 4,135,776 A | | 1/1979 | Ailawadhi et al. | 339/177 R |
| 4,236,188 A | | 11/1980 | Prochazka | 361/111 |
| 4,241,973 A | | 12/1980 | Mayer et al. | 339/143 R |
| 4,346,958 A | | 8/1982 | Blanchard | 339/177 R |
| 4,408,822 A | | 10/1983 | Nikitas | 339/177 R |
| 4,421,377 A | | 12/1983 | Spinner | 339/177 R |
| 4,496,208 A | | 1/1985 | Spinner et al. | 339/177 R |
| 4,676,577 A | | 6/1987 | Szegda | 439/584 |
| 4,687,272 A | | 8/1987 | Spinner et al. | 439/271 |
| 4,696,532 A | | 9/1987 | Mattis | 439/863 |
| 4,824,401 A | | 4/1989 | Spinner | 439/584 |
| 4,854,893 A | | 8/1989 | Morris | 439/578 |
| 4,923,412 A | | 5/1990 | Morris | 439/578 |
| 4,952,174 A | | 8/1990 | Sucht et al. | 439/584 |
| 5,011,432 A | | 4/1991 | Sucht et al. | 439/584 |
| 5,137,470 A | | 8/1992 | Doles | 439/578 |

(Continued)

FOREIGN PATENT DOCUMENTS

CH 690 946 A5 4/1996

(Continued)

*Primary Examiner*—Ross Gushi
(74) *Attorney, Agent, or Firm*—Joseph M. Homa

(57) ABSTRACT

A coaxial connector includes a removable back nut, an outer body, and a center conductor supported within the outer body by a dielectric. A clamp ring is rotatably disposed within the central bore of the back nut. A prepared end of a coaxial cable is inserted through the back nut, and the end portion of the outer conductor of the coaxial cable is flared outwardly. As the back nut is tightened onto the outer body, the flared end of the outer conductor is directly clamped between mating clamping surfaces formed on the clamp ring and the outer body. An optional compression member is provided, and is axially displaced into the outer body as the back nut is tightened for engaging the female socket to seize the inner conductor of the cable. A seal disposed in the back nut forms a seal between the back nut, the clamp ring, and the cable jacket. The back nut can be tightened without twisting the coaxial cable.

4 Claims, 3 Drawing Sheets

U.S. PATENT DOCUMENTS

| | | | | |
|---|---|---|---|---|
| 5,137,471 | A | 8/1992 | Verespej et al. | 439/585 |
| 5,154,636 | A | 10/1992 | Vaccaro et al. | 439/583 |
| 5,166,477 | A | 11/1992 | Perin, Jr. et al. | 174/74 R |
| 5,167,533 | A | 12/1992 | Rauwolf | 439/583 |
| 5,284,449 | A | 2/1994 | Vaccaro | 439/583 |
| 5,352,134 | A | 10/1994 | Jacobsen et al. | 439/584 |
| 5,354,217 | A | 10/1994 | Gabel et al. | 439/583 |
| 5,518,420 | A | 5/1996 | Pitschi | 439/578 |
| 5,595,502 | A | 1/1997 | Allison | 439/429 |
| 5,651,698 | A | 7/1997 | Locati et al. | 439/578 |
| 5,766,037 | A | 6/1998 | Nelson | 439/583 |
| 5,769,662 | A | 6/1998 | Stabile et al. | 439/578 |
| 5,795,188 | A | 8/1998 | Harwath | 439/583 |
| 5,830,009 | A | 11/1998 | Tettinger | 439/578 |
| 5,857,872 | A | 1/1999 | Tettinger | 439/578 |
| 5,871,372 | A | 2/1999 | Kanda et al. | 439/583 |
| 5,938,474 | A * | 8/1999 | Nelson | 439/583 |
| 5,984,723 | A | 11/1999 | Wild | 439/583 |
| 5,993,254 | A | 11/1999 | Pitschi et al. | 439/584 |
| 6,019,635 | A | 2/2000 | Nelson | 439/583 |
| 6,019,636 | A | 2/2000 | Langham | 439/584 |
| 6,102,738 | A * | 8/2000 | Macek et al. | 439/584 |
| 6,133,532 | A | 10/2000 | Lundbäck et al. | 174/88 |
| 6,148,513 | A | 11/2000 | Schiefer et al. | 29/858 |
| 6,183,298 | B1 | 2/2001 | Henningsen | 439/578 |
| 6,210,222 | B1 | 4/2001 | Langham et al. | 439/583 |
| 6,217,384 | B1 | 4/2001 | Strasser et al. | 439/583 |
| 6,267,621 | B1 | 7/2001 | Pitschi et al. | 439/584 |
| 6,309,251 | B1 | 10/2001 | Tang | 439/584 |
| 6,331,123 | B1 | 12/2001 | Rodrigues | 439/584 |
| 6,383,019 | B1 | 5/2002 | Wild | 439/578 |
| 6,439,924 | B1 | 8/2002 | Kooiman | 439/578 |
| 6,513,244 | B1 | 2/2003 | Andreescu | 30/90.2 |
| 6,592,403 | B1 | 7/2003 | Koiman | 439/578 |
| 6,607,398 | B1 | 8/2003 | Henningsen | 439/578 |
| 6,769,933 | B1 | 8/2004 | Bence et al. | 439/578 |
| 6,793,529 | B1 | 9/2004 | Buenz | 439/583 |
| 6,802,738 | B1 | 10/2004 | Henningsen | 439/583 |
| 6,802,739 | B1 | 10/2004 | Henningsen | 439/584 |
| 6,955,562 | B1 | 10/2005 | Henningsen | 439/578 |
| 2005/0118865 | A1 | 6/2005 | Henningsen | 439/578 |
| 2005/0159043 | A1 | 7/2005 | Harwath et al. | 439/578 |
| 2005/0159044 | A1 | 7/2005 | Harwath et al. | 439/578 |
| 2006/0040552 | A1 * | 2/2006 | Henningsen | 439/578 |

FOREIGN PATENT DOCUMENTS

| | | |
|---|---|---|
| DE | 900 364 | 12/1953 |
| DE | 1 905 182 | 9/1970 |
| DE | 4 020 326 | 1/1992 |
| DE | 298 00 824 | 4/1998 |
| EP | 0 757 408 | 2/1997 |
| EP | 1 122 835 | 8/2001 |
| EP | 1 148 592 | 10/2001 |
| EP | 1 376 773 | 1/2004 |
| EP | 1 028 498 | 11/2004 |
| EP | 1 303 005 | 3/2005 |
| EP | 1 303 010 | 4/2005 |
| GB | 1 421 215 | 1/1976 |
| GB | 2 298 971 | 9/1996 |
| WO | WO 2004/055943 | 7/2004 |
| WO | WO 2005/027276 | 3/2005 |

* cited by examiner

COAXIAL CONNECTOR WITH BACK NUT CLAMPING RING

TECHNICAL FIELD

The present invention relates generally to a coaxial connector for coaxial cables, and more particularly, to a coaxial connector that both clamps the outer conductor of the cable and seizes the inner conductor of the cable.

BACKGROUND OF THE INVENTION

Coaxial cables are widely used in the cable television and telecommunications industry to distribute cable television and other electrical signals. Such cables include a central inner conductor surrounded by a low loss, high dielectric foam. The foam dielectric is, in turn, surrounded by a metallic outer conductor which may be cylindrical or corrugated. A protective insulating jacket, or sheath, surrounds the metallic outer conductor. The ends of such coaxial cables must be connected to junction boxes, amplifiers, and other coaxial ports, and coaxial connectors are well known for terminating the ends of coaxial cables.

In order to properly transmit an electrical signal, a coaxial connector should ensure that a reliable electrical connection is achieved between the outer body of the connector and the outer conductor of the coaxial cable. Likewise, a suitable coaxial connector must achieve a reliable electrical connection between the center conductor of the connector and the inner conductor of the coaxial cable. In addition, reliable coaxial connectors must form a secure mechanical connection to the end of the coaxial cable, since mechanical separation of the connector from the end of the cable will interfere with successful transmission of the desired electrical signal.

Coaxial connectors are known which achieve secure electrical and mechanical coupling with the end of a coaxial cable. However, the complexity of such connectors, their relatively high parts count, and the burden imposed upon the technician during installation, are all significant for such known coaxial connectors.

Current coaxial cable connectors on the market consist of a number of moving parts, typically a standard front end which includes an inner terminal or center conductor, an outer terminal or outer body, a dielectric insulator for supporting the center conductor within the outer body, and a moveable back nut which encapsulates a number of seals, retaining rings and the like. U.S. Pat. No. 6,133,532 shows one such connector having a back nut which encapsulates three different moving parts (a locking device, guide surface and inner sleeve) as well as three separate O-ring seals. The large number of moving parts in the back nut portion complicates the fitting of a coaxial cable which usually requires the use of several specialized tools. Additionally, the risk of connector malfunctioning and mounting problems increases with a higher number of moving parts, since there is a greater chance that at least one part may be defective, missing or incorrectly attached.

Likewise, U.S. Pat. No. 4,952,174 to Sucht, et al. discloses a coaxial connector wherein the back nut houses a cone, a mandrel, a mandrel shell, a tined ferrule, and a seal ring. The cone operates together with the center conductor of the connector to bite into the inner conductor of the coaxial cable. The tined ferrule bites into the outer surface of the outer conductor of the coaxial cable and forces such outer conductor against the mandrel. Apart from the relatively large number of parts, there is no direct contact between the outer conductor of the coaxial cable and the outer body of the connector.

Similarly, U.S. Pat. No. 4,676,577 to Szegda discloses a coaxial connector for use with coaxial cable and including a front body, a center conductor supported within the front body and insulated therefrom, and a rear nut (or cap body). The center conductor of the front body includes a collet for receiving the inner conductor of the coaxial cable. An insulative seizure bushing is positioned within the front body to constrict the collet when the seizure bushing is axially displaced. The front body also includes a mandrel for being inserted into the coaxial cable just inside the outer conductor thereof; this mandrel is axially movable relative to the front body and engages the seizure bushing. The rear nut includes an outer conductor clamp member for gripping the outer surface of the coaxial cable outer conductor, as well as a clamp ring having a ramped surface and engaging an o-ring. As the rear nut is tightened onto the front body, the outer conductor clamp member engages a ramp on the front body causing the outer conductor clamp member to be radially compressed inwardly against the outer conductor of the coaxial cable; likewise, the outer conductor clamp member engages the ramped surface of the clamp ring, again forcing the outer conductor clamp member to be compressed against the outer conductor of the coaxial cable, while compressing the o-ring within the rear nut. Simultaneously, the outer conductor clamp member engages, and axially displaces, the mandrel and seizure bushing within the front body to constrict the center conductor collet.

U.S. Pat. No. 6,183,298 to Henningsen also discloses a coaxial connector having a main body, a bushing or back nut, a center conductor, and an insulator supporting the center conductor within the main body. The Henningsen '298 patent includes an axially displaceable member for radially compressing the center conductor of the connector about the inner conductor of the cable. However, the back nut, or bushing, again contains additional movable parts, including a slotted ferrule, an inner bushing, and a friction reducing disk.

Due to the large number of moving parts encapsulated in the back nut of most conventional connectors, the outer conductor must be thoroughly cleared of all glue and adhesive material that may hinder or jam the parts during mounting and tightening, or a poor electrical connection may result. This process can prove to be quite difficult and time-consuming.

The manufacture and assembly of conventional connectors is also expensive in terms of time taken and material costs due to the number of parts enclosed in the back nut, which have to be manufactured and assembled.

The present applicant filed U.S. patent application Ser. No. 10/869,105 on Jun. 15, 2004, entitled "Coaxial Connector with Center Conductor Seizure", and the disclosure of such prior-filed application is hereby incorporated as if fully set forth herein. In this prior patent application, applicant disclosed a simplified coaxial connector for use with coaxial cable, including both rigid cable and semi-rigid corrugated cable, wherein the connector is comprised of a relatively small number of components. The connector disclosed in such prior application serves to both clamp a flared end of the outer conductor between the back nut and the connector body, and to seize the inner conductor of the coaxial cable. However, applicant has discovered that tightening of the back nut onto the connector body can sometimes apply a twisting force to the end of the coaxial cable.

It is generally preferred to avoid twisting or rotation of the coaxial cable when the back nut is being tightened onto the body of the connector.

Accordingly, an object of the present invention is to provide an improved coaxial connector of the general type disclosed in applicant's prior-filed application identified above which minimizes any tendency for the end of the coaxial cable to be twisted as the back nut is tightened onto the connector body.

A further object of the invention is to provide such an improved coaxial connector that minimizes the number of components incorporated within such coaxial connector, thus reducing manufacturing expense, assembly time, and simplifying installation.

These and other objects of the present invention will become more apparent to those skilled in the art as the description of the present invention proceeds.

SUMMARY OF THE INVENTION

Briefly described, and in accordance with a preferred embodiment thereof, the present invention provides a coaxial cable connector that includes a tubular outer body, a back nut, a dielectric supported within the outer body, and a center conductor extending through and supported by the dielectric. In addition, a clamp ring is disposed within the central bore of the back nut and is freely rotatable therein. The outer body has first and second opposing ends and a central bore extending therethrough along a central axis between such first and second ends. An annular clamping surface is provided on the first end of the outer body for engaging an inner surface of the outer conductor of a coaxial cable. The back nut also has a central bore extending between first and second opposing ends. The first end of the back nut receives the prepared end of a coaxial cable, and the second end of the back nut releasably engages, as by fastening threads or the like, the first end of the outer body. The back nut central bore has an internal diameter. An inwardly-directed flange is provided at the first end of the back nut central bore of reduced internal diameter. Preferably, the reduced internal diameter of the inwardly-directed flange of the back nut is commensurate with the outer diameter of the protective jacket for allowing the prepared end of the coaxial cable to be inserted therein.

A first end of the center conductor extends through a central bore of the first dielectric and between first and second ends. The first end of the center conductor receives the inner conductor of the coaxial cable, while the second end of the center conductor extends generally within the second end of the outer body.

The clamp ring has an outer diameter commensurate with the internal diameter of the back nut central bore. The clamp ring includes a first end which is engaged by the inwardly-directed flange of the back nut, as well as an opposing second end that includes an annular clamping surface for engaging the outer surface of the outer conductor proximate the prepared end of the coaxial cable. The clamping surface formed on the first end of the outer body and the clamping surface of the clamp ring collectively clamp, or "sandwich", an exposed portion of the outer conductor of the coaxial cable therebetween as the back nut is engaged over the first end of the outer body. In the preferred embodiment, a portion of the inner wall bounding the central bore of the back nut has a shallow annular recess formed therein proximate the inwardly-directed flange thereof; the outer surface of the clamp ring is provided with a projecting detent for extending within such annular recess to retain the clamp ring within the back nut.

Preferably, a sealing member such as an O-ring is seated within the central bore of the back nut to form a seal with the protective jacket of the coaxial cable. In the preferred embodiment, the O-ring is disposed between the inwardly-directed flange of the back nut and the first end of the clamp ring. In this manner, the O-ring forms a compression seal simultaneously between the back nut, the clamp ring, and the protective jacket of the coaxial cable.

Preferably, fastening threads are formed on both the second end of the central bore of the back nut and on a mating outer surface proximate to, but inset from, the annular clamping surface thereof at the first end of the outer body to engage and mate with the threaded portion of the back nut. A sealing member such as an O-ring is optionally provided to extend about the outer body to sealingly engage the second end of the back nut when the back nut is engaged over the first end of the outer body. In addition, a front nut may be rotatably secured about the second end of the outer body. The front nut includes an internally-threaded surface for mating with an externally-threaded mating component of a terminal block or the like.

The clamping surface formed upon the clamping ring includes an inwardly-directed annular step to engage the outer surface of the outer conductor of the coaxial cable. Preferably, the exposed portion of the outer conductor of the coaxial cable includes a flared lip, and the inwardly-directed annular step of the clamping ring engages the outer surface of such flared lip. In the preferred embodiment, the inwardly-directed annular step of the clamping ring includes a beveled surface for engaging the outer surface of such flared lip, and the annular clamping surface formed upon the first end of the outer body is tapered for entering within the outer conductor of the coaxial cable to engage the inner surface thereof.

While the present invention may be used without actively seizing the inner conductor of the coaxial cable, it can also incorporate an inner conductor seizure mechanism if desired. In this event, the first end of the center conductor includes a compressible female socket opening toward the first end of the outer body for receiving the inner conductor extending from the prepared end of the coaxial cable. An electrically insulative seizure compressor is preferably disposed within the first end of the outer body. The seizure compressor includes a first engagement surface for being engaged by the outer conductor of the coaxial cable, and a second engagement surface for engaging the compressible female socket. As the back nut is tightened onto the first end of the outer body, the seizure compressor is axially displaced further into the outer body, causing the second engagement surface to compress the female socket, and thereby seize the inner conductor of the coaxial cable without rotating the cable.

DETAILED DESCRIPTION OF THE INVENTION

Figure 1:
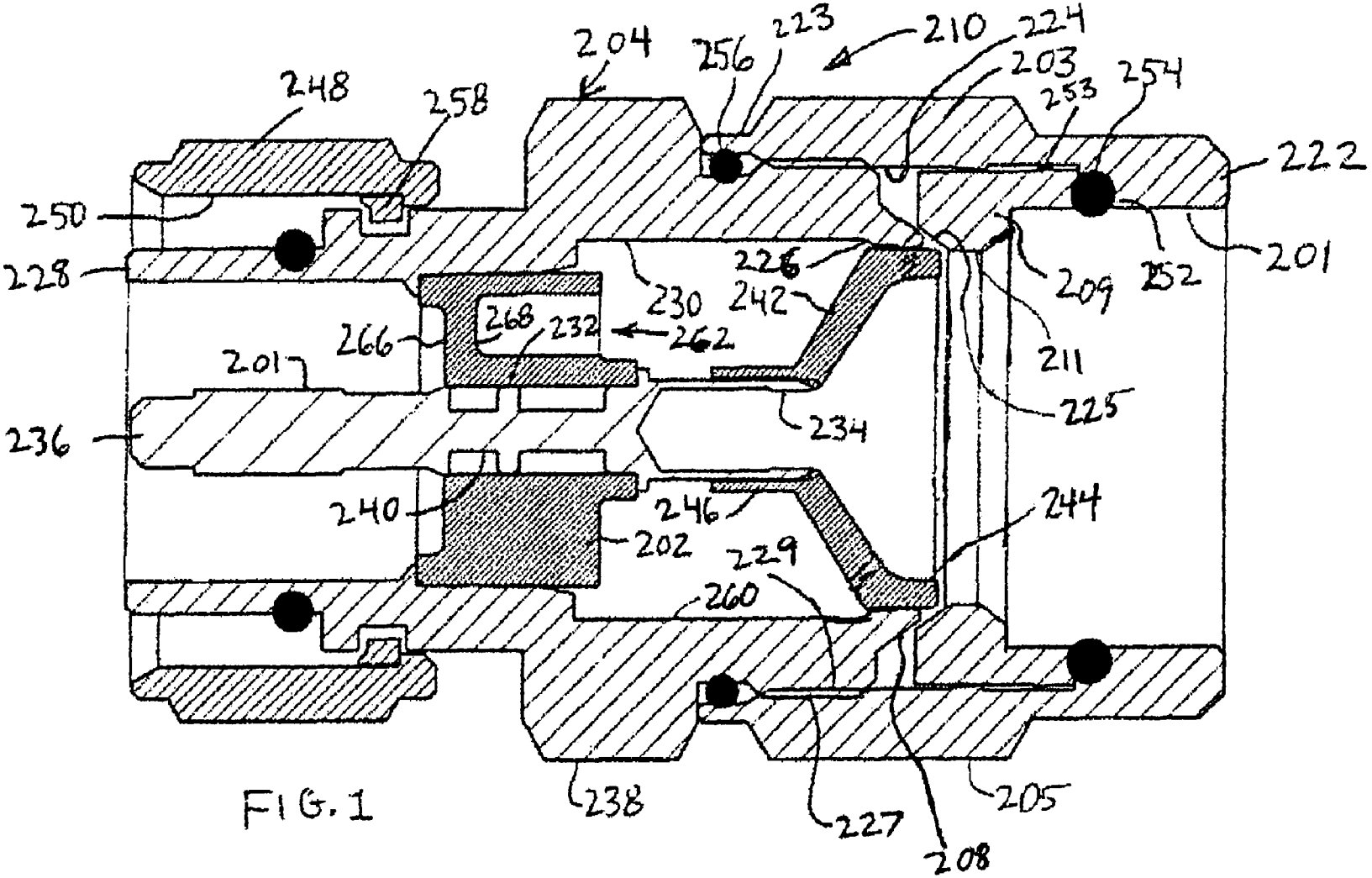
FIG. 1 is a sectional view of a connector, according to a preferred embodiment of the present invention.

FIG. 1 illustrates a preferred embodiment of the coaxial connector of the present invention. Coaxial connector 210 includes back nut 203 having an inner surface 224 defining a central bore extending between first end 222 and second end 223. This inner surface 224 has a predetermined internal diameter. First end 222 of back nut 203 includes an inwardly-directed flange 201 of reduced internal diameter. The reduced internal diameter of inwardly-directed flange 201 is preferably commensurate with the outer diameter of the protective jacket of the coaxial cable for allowing the prepared end of the coaxial cable to be inserted therein.

Back nut 203 is preferably made of machine-quality brass plated with a coating of NiTin6. Inner surface 224 of back nut 203 also includes a threaded portion 227 disposed proximate second end 223; threaded portion 227 can be used to secure back nut 203 to the outer body 204 of connector 210, in a manner to be described. The outer surface of back nut 203 includes a preferably hexagonally-shaped region 205 to which a wrench may be applied when connector 210 is being installed.

Figure 2:
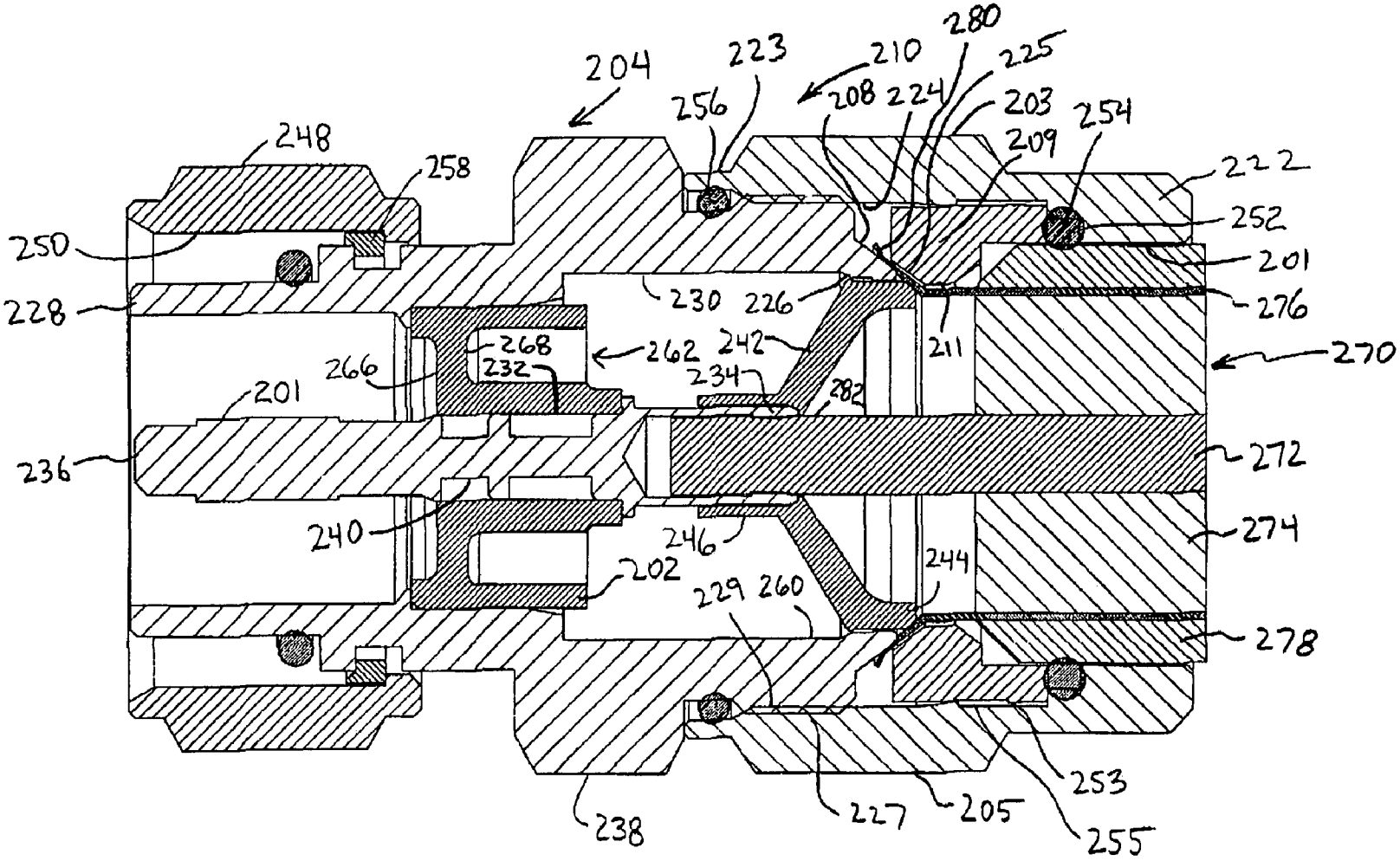
FIG. 2 is a sectional view of the connector of FIG. 1 engaging an end of a coaxial cable.

As shown in FIG. 2, coaxial connector 210 is adapted to receive a prepared end of coaxial cable 270. Coaxial cable 270 includes an inner conductor 272 surrounded by an insulating dielectric 274. Dielectric 274 is, in turn, surrounded by an outer conductor 276; finally, a protective, insulative cable jacket 278 surrounds outer conductor 276. As shown in FIG. 2, the end of coaxial cable 270 has been prepared by removing a portion of the cable jacket 278 to expose an end portion of outer conductor 276, by coring away an end portion of the dielectric 274 to expose an end portion 282 of inner conductor 272, and by flaring out the end of outer conductor 276 to form a flared lip portion 280. The end portion 282 of inner conductor 272 projects axially beyond the distal end of the flared lip portion 280, the distal end of the dielectric 274, and the distal end of the jacket 278. Jacket 278 is removed from the end of coaxial able 270 around the outer conductor 276 at the portion of the outer conductor 276 that forms the flared lip portion 280, and also preferably proximate the flared lip portion 280. Similarly, dielectric 274 is removed from the end of coaxial cable 270 between the inner conductor 272 and the outer conductor 276 at the portion of the outer conductor 276 that forms the flared lip portion 280, and also preferably proximate the flared lip portion 280. Preferably, dielectric 274 does not touch compressor member 242.

Figure 3:
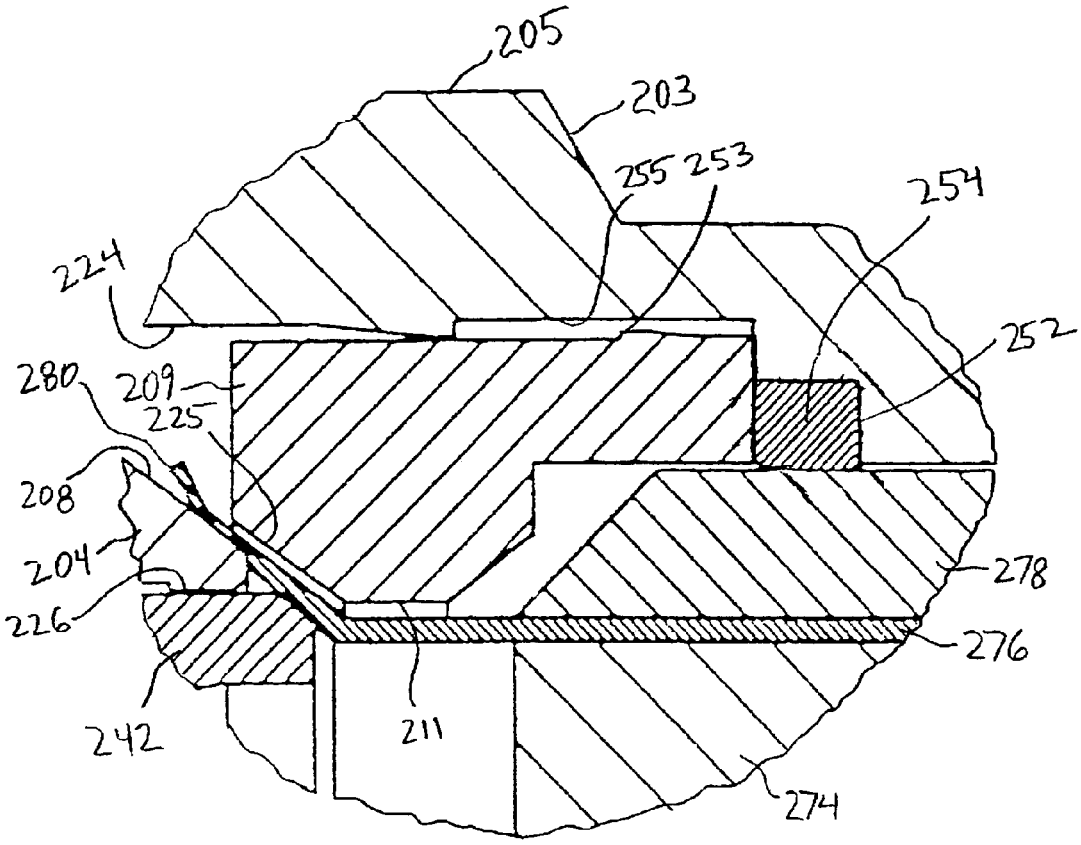
FIG. 3 is an enlarged view of a portion of FIG. 2 illustrating a detent projecting from the clamp ring for retaining the clamp ring within the back nut while permitting relative rotation and limited axial sliding movement therebetween.

A clamp ring 209 is disposed within the central bore of back nut 203 and is rotatable, preferably freely rotatable, therein. Clamp ring 209 has an outer diameter generally commensurate with the internal diameter of inner surface 224 defining the central bore of back nut 203. Clamp ring 209 has a generally cylindrical outer surface; this outer surface preferably includes a projecting detent 253, shown best in the enlarged drawing of FIG. 3, for extending within an annular recess 255 of back nut 203. Detent 253 and recess 255 function to retain clamp ring 209 within back nut 203, while allowing clamp ring 209 both to rotate relative to back nut 203, and to slide axially within back nut 203 over a short axial distance (allowing clamp ring 209 to slide away from a sealing member 254 until connector 210 is finally assembled onto cable 270). Clamp ring 209 has a first end which is engaged by inwardly-directed flange 201 of back nut 203. As shown in FIGS. 1 and 2, the opposing second end of clamp ring 209 includes an annular clamping surface 225 for engaging the outer surface of outer conductor 276 proximate the prepared end of coaxial cable 270. Annular clamping surface 225 is preferably a beveled surface formed upon an edge of an inwardly-directed annular step 211 provided at the second end of annular clamp ring 209.

Referring to FIG. 1, connector 210 also includes a generally tubular outer body 204 extending between first end 226 and second end 228. Outer body 204 has an inner surface 230 defining a central bore extending therethrough along a central axis between first and second ends 226 and 228 thereof. First end 226 of outer body 204 is adapted to be releasably secured to second end 223 of back nut 203. Preferably, external threads 229 are formed on the outer surface of outer body 204 proximate first end 226 thereof for engaging and mating with threaded portion 227 of back nut 203. A sealing layer or sealing member, such as O-ring 256, is disposed about the outer surface of outer body 204 axially closer to end 228 than threaded surface 229 and preferably adjacent thereto; O-ring 256 is adapted to sealingly engage against second end 223 of back nut 203 when back nut 203 is tightened onto first end 226 of outer body 204, thereby providing a seal between second end 223 of back nut 203 and the outer surface of outer body 204. O-ring 256 is preferably made of rubber compounds, more preferably ethylene propylene rubber, even more preferably a terpolymer such as Ethylene Propylene Diene Monomer (EPDM). EPDM is termed a terpolymer because it is comprised of three components (Ethylene, Propylene, and Diene). Alternatively, such O-rings could be made of silicone.

Referring to FIGS. 1 and 2, the outer surface of outer body 204 at first end 226 also includes annular clamping surface 208 integral therewith for engaging the inner surface of the flared lip portion 280 of outer conductor 276 of coaxial cable 270. Clamping surface 208 is preferably tapered for sliding under and entering within flared lip portion 280 of outer conductor 276 of coaxial cable 270, and for engaging the inner surface of flared lip portion 280.

It will be noted that the threaded surface 229 of outer body 204 is axially inset toward end 228 relative to clamping surface 208, i.e., threaded surface 229 stops short of tapered end 226 of outer body 204; this allows the reduced diameter, tapered clamping surface 208 at end 226 to protrude into flared lip portion 280 of outer conductor 276 of coaxial cable 270. Outer body 204 is preferably made of machine-quality brass plated with a coating of either NiTin-6 or silver; alternatively, outer body 204 could be made from aluminum. In preferred embodiments, the outer surface of outer body 204 comprises hexagonal region 238 for allowing a wrench to engage therewith.

As back nut 203 is tightened over first end 226 of outer body 204, clamping surface 225 and clamping surface 208 collectively serve to sandwich, and therefore clamp, at least a portion of flared lip portion 280 of outer conductor 276 of coaxial cable 270 therebetween. This clamping action provides good mechanical joinder of coaxial cable 270 to coaxial connector 210. It also forms good electrical contact between outer conductor 276 of coaxial cable 270 and outer body 204 of coaxial connector 210.

A first dielectric insulator 202 is disposed within central bore 230 of outer body 204. Dielectric 202 has an inner surface defining a central bore 232 extending therethrough along the central axis of outer body 204. Dielectric member 202 is preferably made of TPX® Polymethylpentene polymer; it could also be made from PTFE Teflon® from DuPont, or from TOPAS® plastic from the Ticona Division of Celanese AG. Within FIG. 1, although dielectric member 202 appears to have a U-shaped cross-section extending outwardly along its radius, dielectric member 202 is preferably solid with a central bore 232 extending therethrough, and a series of radially-spaced holes 262 are preferably formed therein opening toward first end 226 of outer body 204; such holes help to maintain the characteristic impedance of the transmission path to minimize signal reflections. Central bore 232 fully extends through dielectric 202, exiting at back wall 266 thereof. However, hole 262 is a blind hole and stops short of back wall 266. For purposes of clarity, only one hole 262 is shown in FIG. 1; the bottom wall, or end wall, of hole 262 is indicated by reference numeral 268.

Referring to FIG. 1, center conductor 201 extends through central bore 232 of dielectric member 202 and is supported thereby. Center conductor 201 extends between a first end formed as a compressible female socket 234 and an opposing second end 236 formed as a male pin extending proximate to second end 228 of outer body 204. A front nut 248 is rotatably secured about second end 228 of outer body 204; front nut 248 preferably includes an internally-threaded surface 250 for mating with an externally-threaded mating component. Front nut 248 is preferably made of brass plated with a coating of NiTin-6, or nickel, or silver, or white bronze (copper, tin and zinc); alternatively, it could be made from aluminum. Front nut 248 is retained on outer body 204 by spring-biased retaining snap ring 258; snap ring 258 is preferably made of unplated brass, or phosphor-bronze. Snap ring 258 is slid into a groove provided on the outer surface of outer body 204 proximate second end 228; front end nut 248 is then slid over second end 228 of outer body 204, compressing snap ring 258 until part of front nut 248 slides beyond snap ring 258. Snap ring 258 then pops partially out of its groove to retain front end nut 248 on outer body 204.

Reduced diameter grooves 240 are provided on the outer surface of center conductor 201 proximate dielectric member 202, for the purpose of maintaining a relatively continuous characteristic impedance along the signal path. These grooves 240 provide electrical impedance compensation, as the impedance of the connector changes due to the presence of dielectric 202 as compared with air. The compressible female socket 234 is open toward first end 226 of outer body 204. Female socket 234 may initially be a cup-shaped member into which longitudinal slots are cut to form resilient fingers for receiving and engaging the exposed end portion 282 of inner conductor 272 of coaxial cable 270. Center conductor 201 is preferably made of tin-bronze alloy, brass, or phosphor-bronze alloy, plated with silver, gold, or NiTin-6; alternatively, it could be made from berylium copper (BeCu) alloy. While the second end of center conductor 201 is shown as a male pin, it could instead be formed as a female port, if desired.

As mentioned above, the coaxial connector of the present invention may optionally include a mechanism for seizing inner conductor 272 of coaxial cable 270. To that end, an electrically insulative seizure compressor member 242 is disposed within first end 226 of outer body 204. Seizure compressor 242 preferably has a funnel shape, more preferably a funnel shape with a truncated spout, and includes a first larger diameter end 244 for engaging the flared lip portion of the outer conductor of the coaxial cable. The second, smaller diameter end 246 engages the compressible female socket 234, for example, by engaging the resilient fingers of socket 234. As back nut 203 is tightened onto outer body 204, at least a portion of seizure compressor 242 is axially displaced by flared lip portion 280 of the coaxial cable outer conductor 276, driven by back nut 203 and clamp ring 209, further into outer body 204, thereby compressing female socket 234 radially inwardly to seize exposed portion 282 of inner conductor 272 of coaxial cable 270. Preferably, at least the radially outermost portion of the seizure compressor member 242 is axially displaced, relative to the outer body 204, toward end 228. Seizure compressor member 242 is preferably made of reinforced crystalline thermoplastic polymer such as POM Delrin® acetal resin, which is strong, rigid, has excellent dimensional stability, a low coefficient of friction, has good abrasion and impact resistance, and has low moisture absorption. Alternatively, seizure compressor 242 could be made from 30% glass fiber reinforced polypropylene (PP), or from TOPAS® plastic from the Ticona Division of Celanese AG. Seizure compressor member 242 preferably snaps into a groove 260 formed in the inner surface of outer body 204 proximate first end 226 thereof. Preferably, groove 260 is sufficiently longitudinally wide to permit seizure compressor member 242 to be fully axially displaced therein.

An O-ring 254 is seated between back nut 203 and clamping ring 209 and extends into central bore 224 of back nut 203 to form a seal with protective jacket 278 of coaxial cable 270. In the preferred embodiment, O-ring 254 is disposed between the first end of clamp ring 209 and an inner side wall 252 of the inwardly-directed flange 201 of back nut 203. In this manner, O-ring 254 preferably forms a compression seal simultaneously between back nut 203, clamp ring 209, and protective jacket 278 of coaxial cable 270, as shown best in FIG. 3.

Prior to shipment to a customer, back nut 203 is preferably temporarily affixed to first end 226 of outer body 204 by mutually threading such components together at least one turn to secure the parts together for shipment. Prior to installing connector 210, the user cores the end of cable 270 (i.e., cores out dielectric foam 274 between inner conductor 272 and outer conductor 276), and strips protective jacket 278 from the end of coaxial cable 270, so that the exposed length 282 of inner conductor 272, the coring depth of dielectric foam 274, and the stripped length of cable jacket 278 that is cut back, are all pre-selected to match the connector. The back nut 203, together with clamping ring 209, are then installed over the stripped outer conductor 276. Next, the user flares outer conductor 276 of coaxial cable 270 with a flaring tool, and simultaneously removes any adhesive or foam from the inside of outer conductor 276. Any foam remaining on inner conductor 272 of cable 270 is removed to ensure good electrical contact. Then the back nut 203 and the first end 226 of the outer body 204 are threaded together to complete the installation.

Those skilled in the art will note that the above-described connector is of extremely simple design and requires a minimal number of components. It will also be noted that the outer conductor of the coaxial cable is directly clamped between the outer body 204 and clamp ring 209 of the coaxial connector, without requiring any additional components. Moreover, the disclosed embodiment also serves to positively seize the inner conductor of the cable. As a result of its simple design, the disclosed connector can be manufactured relatively inexpensively and may be installed to the end of a coaxial cable relatively quickly and reliably. Because clamp ring 209 can remain in place while back nut 203 is tightened, any torque or twisting force that would otherwise be transmitted to the end of coaxial cable 270 is reduced or eliminated, thereby reducing or eliminating twist of the cable.

While the present invention has been described with respect to a preferred embodiment thereof, such description is for illustrative purposes only, and is not to be construed as limiting the scope of the invention. Various modifications and changes may be made to the described embodiment by those skilled in the art without departing from the true spirit and scope of the invention.

The invention claimed is:

1. A coaxial connector for use with a prepared end of a coaxial cable, the coaxial cable including an inner conductor of a first predetermined diameter, a dielectric surrounding the inner conductor, an outer conductor of a second predetermined diameter surrounding the dielectric, and a protective jacket surrounding the outer conductor, the prepared end of the coaxial cable having an end portion of the dielectric removed to expose an end portion of the inner conductor, the prepared end also having an end portion of the protective jacket removed to expose an exposed end portion of the outer conductor, the outer conductor having opposing inner and outer surfaces, the coaxial connector comprising:

a. a generally tubular outer body having first and second opposing ends and having a central bore extending therethrough along a central axis between the first and second ends thereof, the first end of said outer body having an annular clamping surface for engaging an inner surface of the outer conductor of a coaxial cable;

b. a back nut having an inner surface defining a central bore extending between first and second opposing ends thereof, the first end of the back nut being adapted to receive the prepared end of the coaxial cable, and the second end of the back nut capable of releasably engaging the first end of the outer body, the back nut inner surface having an internal diameter, and the first end of the back nut including an inwardly-directed flange of reduced internal diameter;

c. a first dielectric disposed within the central bore of the outer body, the first dielectric having a central bore extending therethrough along the central axis of the outer body;

d. a center conductor extending through the central bore of the first dielectric and supported thereby, the center conductor extending between first and second ends, the first end of the center conductor capable of receiving the inner conductor of the coaxial cable, and the second end of the center conductor extending proximate the second end of the outer body, wherein the first end of the center conductor includes a compressible female socket opening toward the first end of the outer body for receiving the inner conductor extending from the prepared end of the coaxial cable;

e. a clamp ring disposed within the back nut central bore and rotatable therein, the clamp ring having an outer diameter commensurate with the internal diameter of the back nut, the clamp ring having a first end proximate the inwardly-directed flange of the back nut, and the clamp ring having an opposing second end, the second end of the clamp ring including an annular clamping surface for engaging the outer surface of the outer conductor proximate the prepared end of the coaxial cable; and f. an electrically insulative seizure compressor disposed within the first end of the outer body, the seizure compressor including a first engagement surface for engaging the outer conductor of the coaxial cable and a second engagement surface for engaging the compressible female socket, wherein engagement of the back nut onto the first end of the outer body axially displaces the seizure compressor further into the outer body, and wherein the second engagement surface compresses the female socket to seize the inner conductor of the coaxial cable;

wherein the clamping surface of the outer body and the clamping surface of the clamp ring sandwich the exposed portion of the outer conductor of the coaxial cable therebetween as the back nut is engaged over the first end of the outer body.

2. The coaxial connector recited by claim 1 wherein:

a. the inner surface of the back nut includes a threaded portion proximate the second end thereof; and b. the first end of the outer body includes a threaded surface inset relative to the annular clamping surface thereof, the threaded surface being adapted to engage and mate with a threaded portion of the back nut.

3. The coaxial connector recited by claim 1 wherein the protective jacket of the coaxial cable has an outer diameter, and wherein the reduced internal diameter of the inwardly-directed flange of the back nut is commensurate with the outer diameter of the protective jacket for allowing the prepared end of the coaxial cable to be inserted therein.

4. The coaxial connector recited by claim 1 wherein:

a. a portion of the central bore of the back nut proximate the inwardly-directed flange thereof is bounded by an inner wall, the inner wall having an annular recess formed therein; and b. the clamp ring has a generally cylindrical outer surface, the outer surface of the clamp ring including a projecting detent for extending within said annular recess to retain the clamp ring within the back nut.

* * * * *